US008307752B2

(12) United States Patent
Ryyppö

(10) Patent No.: US 8,307,752 B2
(45) Date of Patent: Nov. 13, 2012

(54) PISTON HYDRAULIC MOTOR

(75) Inventor: Roni Ryyppö, Palokka (FI)

(73) Assignee: Sampo-Hydraulics Oy, Jyskä (FI)

( * ) Notice: Subject to any disclaimer, the term of this patent is extended or adjusted under 35 U.S.C. 154(b) by 1313 days.

(21) Appl. No.: 12/019,796

(22) Filed: Jan. 25, 2008

(65) Prior Publication Data

US 2008/0178732 A1 Jul. 31, 2008

(30) Foreign Application Priority Data

Jan. 26, 2007 (FI) ..... 20075057

(51) Int. Cl.
*F01B 1/06* (2006.01)
*F01B 13/06* (2006.01)

(52) U.S. Cl. ..... 91/498; 91/518

(58) Field of Classification Search ..... 91/491, 91/498, 518; 417/470; 92/72
See application file for complete search history.

(56) References Cited

U.S. PATENT DOCUMENTS

| | | | | |
|---|---|---|---|---|
| 3,403,599 | A | 10/1968 | Guinot | |
| 4,036,323 | A | 7/1977 | Schmall | |
| 4,165,613 | A * | 8/1979 | Bernhoft et al. | 60/420 |
| 4,404,896 | A | 9/1983 | Allart et al. | |
| 4,807,519 | A | 2/1989 | Wüsthof et al. | |
| 5,186,094 | A | 2/1993 | Allart | |
| 5,836,231 | A | 11/1998 | Leinonen | |
| 6,230,829 | B1 | 5/2001 | Martin et al. | |
| 6,269,901 | B1 | 8/2001 | Moffett et al. | |
| 6,367,572 | B1 | 4/2002 | Maletschek et al. | |
| 6,386,307 | B1 | 5/2002 | Martin et al. | |
| 6,494,126 | B1 | 12/2002 | Leinonen | |
| 6,508,328 | B1 | 1/2003 | Kenyon et al. | |
| 6,978,713 | B2 | 12/2005 | Allart et al. | |
| 6,991,058 | B2 | 1/2006 | Cousin et al. | |
| 7,185,579 | B2 | 3/2007 | Allart et al. | |

(Continued)

FOREIGN PATENT DOCUMENTS

| | | | |
|---|---|---|---|
| GB | 2357122 | A | 6/2001 |
| WO | 92/10677 | A1 | 6/1992 |

OTHER PUBLICATIONS

"Twin-Lock System—A Simple Solution to Difficult Task", by Wang Qian, Poclain Hydraulics Beijing Office, P.R. China, published prior to Mar. 17, 2003, http://fluid.power.net/techbriefs/hanghzau/4_34.pdf.

(Continued)

*Primary Examiner* — Devon Kramer
*Assistant Examiner* — Philip Stimpert
(74) *Attorney, Agent, or Firm* — Stiennon & Stiennon

(57) ABSTRACT

A hydraulic motor having pistons, some of which are in a working phase and some are in a non-working phase, whereby the pistons are adapted to rotate the piston hydraulic motor's shaft or casing. To the piston hydraulic motor there are at least two working pressure medium channels, whereby the piston hydraulic motor can be connected for full volume or partial volume. In full volume, all the pistons in the working phase can be brought into the working phase in the motor by a pump's working pressure, whereas in the case of partial volume flow only some pistons can be brought into the working phase by the working pressure. The piston hydraulic motor comprises an actuator, which can close one of the piston hydraulic motor's pressurized inlet channels when the pressure in the other pressure medium channel falls below a certain critical value.

6 Claims, 6 Drawing Sheets

U.S. PATENT DOCUMENTS

| | | | |
|---|---|---|---|
| 7,337,869 | B2 | 3/2008 | Gray et al. |
| 7,377,354 | B2 | 5/2008 | Smalley |
| 7,406,824 | B2 | 8/2008 | Lucienne et al. |
| 7,637,101 | B2 | 12/2009 | Uezono et al. |
| 2004/0032163 | A1 | 2/2004 | Bigo et al. |

OTHER PUBLICATIONS

Search Report issued in FI 20075057.

U.S. Appl. No. 12/020,293, filed Jan. 25, 2008.

* cited by examiner

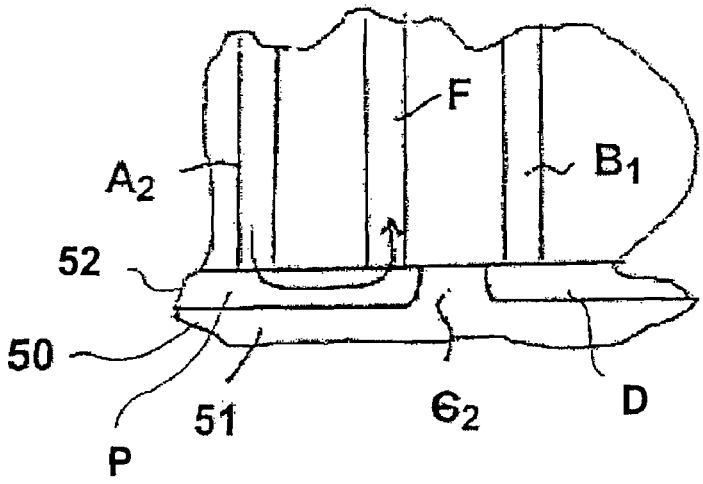
FIG. 2
FIG. 4
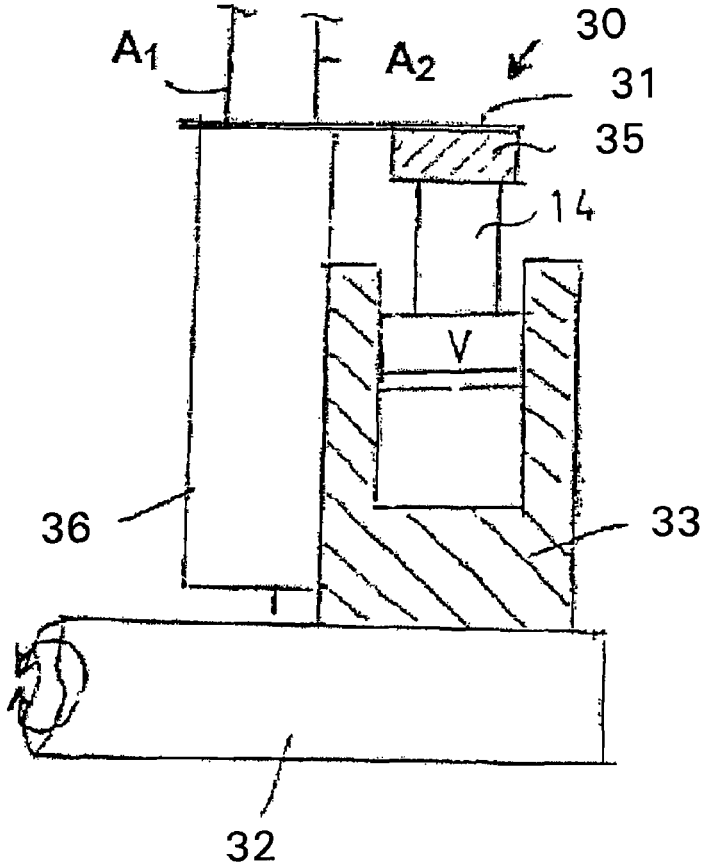

PISTON HYDRAULIC MOTOR

CROSS REFERENCES TO RELATED APPLICATIONS

This application claims priority on Finnish App. No. 20075057, Filed Jan. 26, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a piston hydraulic motor.

There are hydraulic motor requirements, where the hydraulic motor structure should be such, wherein it is possible by the same pump output that feeds the system to change the speed of rotation and the related moment or torque of the hydraulic motor operated by the pump. There are various device drives, where the driving wheel or the feeding roller starts slipping in an undesirable manner. For said problems there ought to be a hydraulic motor, which when located in a hydraulic system would function as a motor, in which slipping would be prevented. Thus, the target is a hydraulic motor, in which, for example, at the so-called full rotational volume, that is, at the lowest speed, the highest moment is achieved and the same pump output can be used for controlling another operating mode, where, for example, at the hydraulic motor's ½ rotational volume a higher speed of rotation and a lower moment are achieved, but where the volume flow of the hydraulic motor's total input and total output remains unchanged, that is, at a certain setting of said pump the departing and arriving oil quantity in the system is fairly constant and also determined by the output of the feeding motor at each time. One half rotational volume parts from the hydraulic motor can be connected purely in series with a conventional hydraulic motor, whereby slipping is prevented in a multi capacity hydraulic motor.

SUMMARY OF THE INVENTION

This application presents a new type of piston hydraulic motor, preferably a radial piston hydraulic motor, which allows at least two different operating modes; an operating mode where the hydraulic motor works at the lowest speed of rotation and at the highest moment and where all the motor volume is full volume, whereby all the pistons of the radial piston hydraulic motor are in operation at the full working pressure produced by the pump, and a partial volume operating mode where the number of pistons working at each time is reduced, whereby, correspondingly, the speed of rotation of the motor will increase and the moment of the hydraulic motor will be reduced. For example, in the system shown in FIG. 5, with a constant pump output several different speeds and moments are achieved as well as at least two different speeds and different moments relating to these.

The invention uses a radial piston hydraulic motor as a multi capacity motor, in which the piston body comprises piston-type cylinders and pistons in these. With each piston a presser wheel is connected, which is adapted to press against a cam ring. The cylinders are located radially in the piston body. In one embodiment, the actual piston body is in a fixed non-rotating position, as is the shaft of the hydraulic motor.

On the shaft there is a distributor, through which hydraulic oil is distributed step by step to each piston and which rotates with the casing, which is rotated by the rotated cam ring. According to the invention, the shaft has a bore, in which there is a control spindle. The control spindle comprises pistons or necks or broadened parts, which operate to close and open oil channels. Thus, by moving the spindle one or the other pressurized oil channel is opened and closed. The device solution thus comprises two pressurized inlet channels $A_1$ and $A_2$ and one outlet channel $A_3$, $A_4$ for the hydraulic motor. When the direction of rotation of the hydraulic motor is changed, the pressurized medium is changed to arrive through the channels $A_3$, $A_4$ and the outgoing flows take place through the two inlet channels $A_1$ and $A_2$.

In the following, the invention will be explained by referring to some advantageous embodiments of the invention shown in the figures of the appended drawings, but there is no intention to restrict the invention to these embodiments only.

BRIEF DESCRIPTION OF THE DRAWINGS

FIG. 2 shows how the control spindle is moved into a position, where another rotational volume is implemented for the piston hydraulic motor.

FIG. 4 shows the principle of an embodiment of the piston hydraulic motor, where the shaft rotates, but the motor casing is non-rotating and the shaft is rotated. The solution for forming a multi capacity motor is the same, that is, as was explained in connection with the earlier figures.

DESCRIPTION OF THE PREFERRED EMBODIMENTS

Figure 1A:
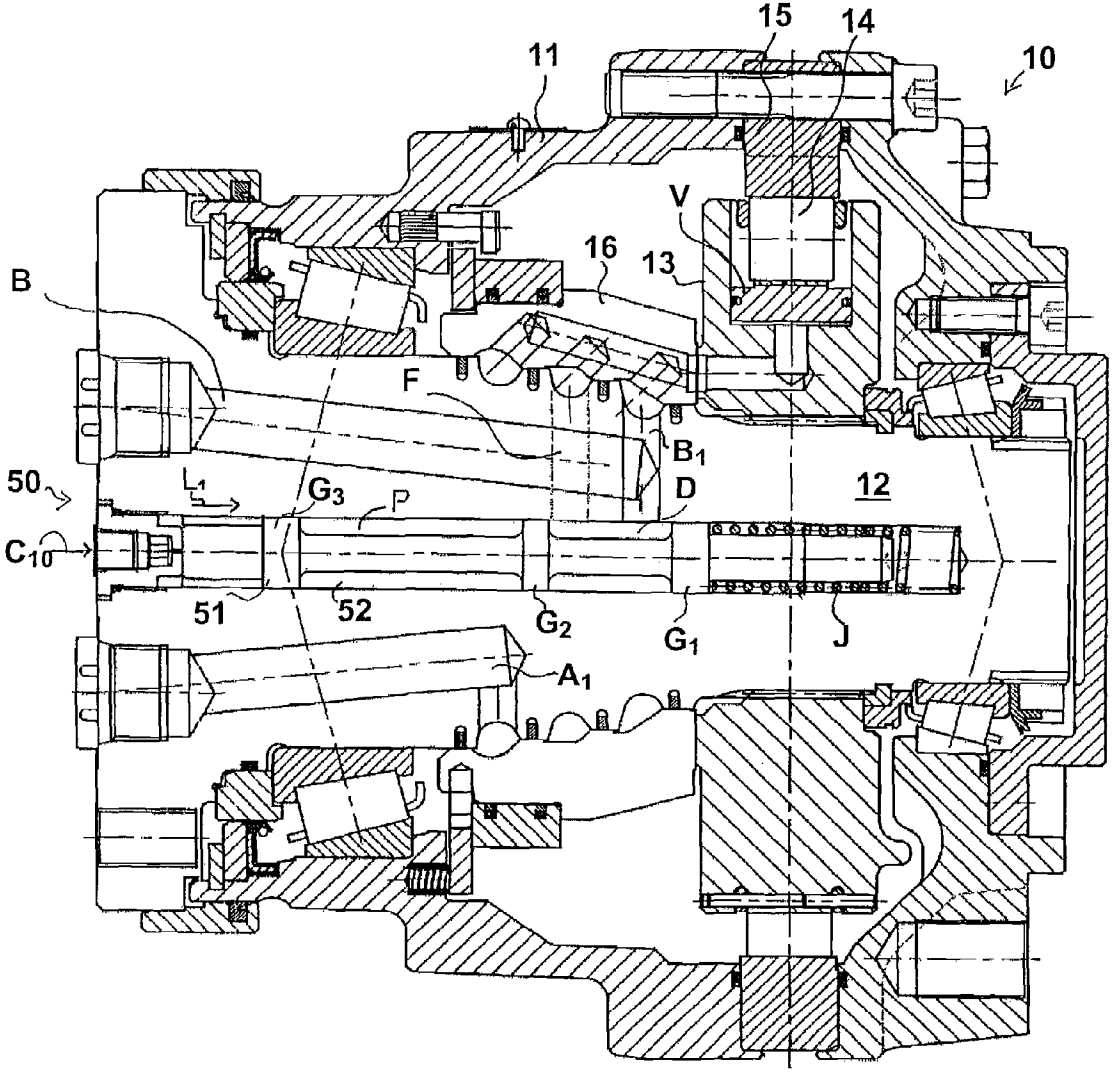
FIGS. 1A and 1B are two different lengthwise cross-sectional views of the multi capacity hydraulic motor according to the invention in order to present the channels.
Figure 1B:
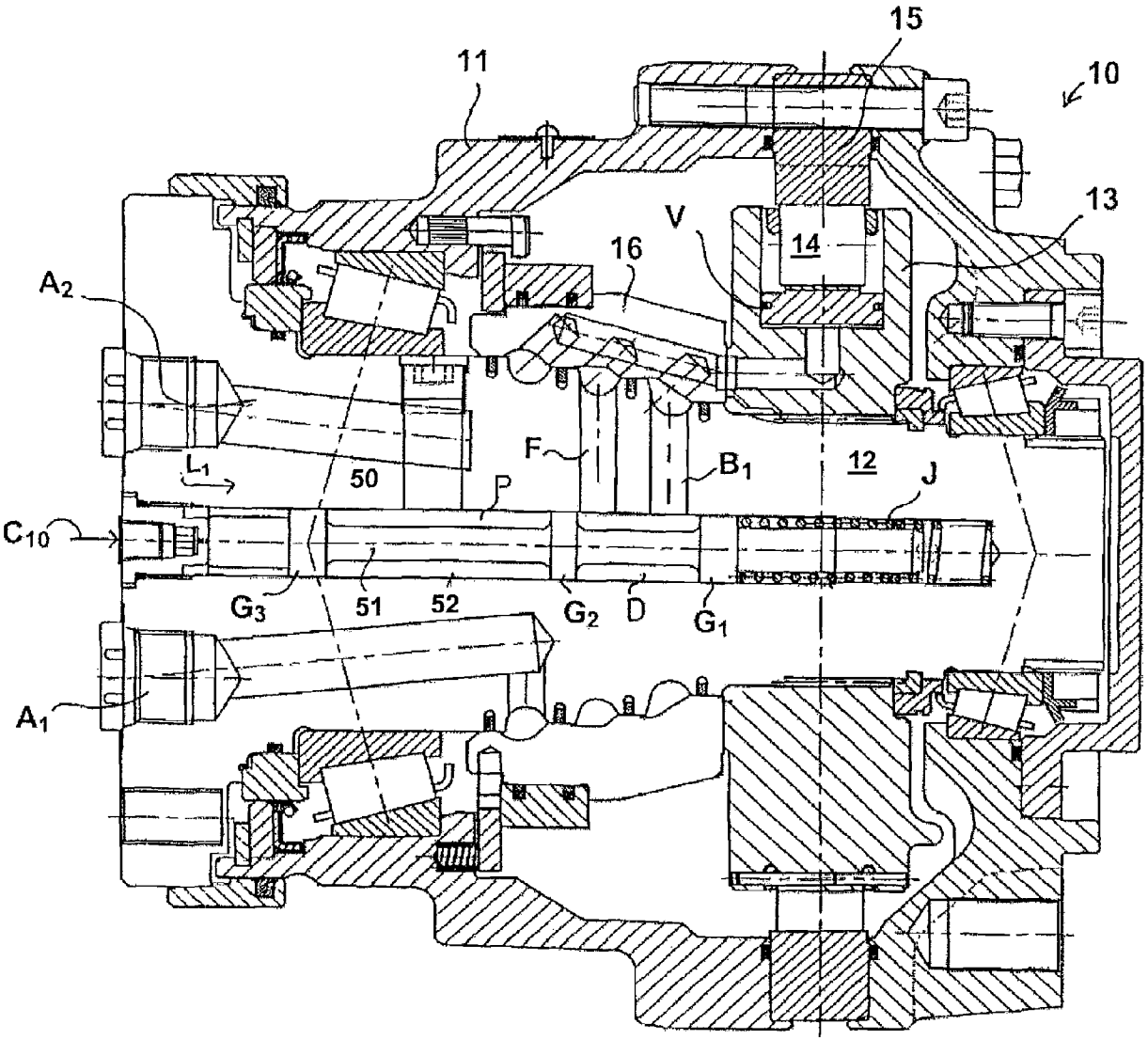

FIGS. 1A and 1B show a piston hydraulic motor 10, which is a radial piston hydraulic motor in this embodiment. It has a rotating outer periphery 11, that is, a casing and a fixedly positioned central shaft 12. The pistons V located in the fixedly positioned pistons bodies 13 surrounding shaft 12 comprise presser wheels 14, which rest against a wave-like cam ring 15 rotated by the pistons. A distributing valve 16 rotates with casing 11 and comprises peripheral millings and from these bores to the frontal face of the distributing valve, and through channels opening from these the pressure medium is conducted to a bank of cylinders $Va_1$, $Va_2$, indicated schematically in FIG. 3, in order to produce power at the right time through the pistons in the working phase to the cam ring 15 in order to rotate this and the casing 11 connected to it. For the pistons V in the working phase a pressurized medium is brought, preferably hydraulic oil, and from the pistons in the non-working phase the almost pressure-free medium, such as oil, is conducted by way of the frontal face of the distributor, that is, the distributing valve 16, into the distributor's outlet channel and further through the channels of the non-rotating shaft 12 to the outlet connection and further out to be separated from the hydraulic motor 10. When changing the pressurization with a directional control valve (not shown) between the motor inlet and outlet, the motor's direction of rotation is changed.

The radial piston hydraulic motor 10 comprises a cylinder body 13 and therein radial cylinders and in these pistons V and presser wheels 14. A rotating distributor 16 has bores in its frontal face in connection with bores in the piston body 13. A pressurized medium, that is, the working pressure, is supplied through inlet channels $A_1$ and $A_2$, shown in FIG. 1B. Channel $A_2$ is a pressure channel, which in the embodiment shown in FIG. 2 conducts the pressurized medium through bores in shaft 12 into a space P in between necks $G_2$, $G_3$ of the spindle 51 of control valve 50 and into channel F and further to the outer periphery of shaft 12 and further through grooves and bores in the distributor's side surface into a specific bore of the piston body 13 in order to conduct the pressurized medium in the correct phase to the pistons V, which are in the working phase, and in order to remove the outgoing oil flow taking place from the pistons V in the discharge phase from the pistons, which are in the concerned phase. Thus, some pistons are in the so-called non-working phase, whereby the pistons remove medium under a lower pressure, such as oil, from the piston space and further through the channel in the piston body 13 to the distributing valve 16 and further through its channels to an outlet channel B located in shaft 12. Each piston V in turn is in the working phase and in turn in the non-working phase, that is, in the oil removing phase. The pistons, which are in the working phase, press the presser wheels connected to the pistons with force against the opposite wave-like surface, that is, the cam ring 15, whereby the motor's 10 casing connected to cam ring 15 will be rotated.

When the central control spindle 51 of control valve 50 with its piston-like necks, that is, broadened parts $G_1$, $G_2$, $G_3$, is in the position shown in FIGS. 1A and 1B, the oil flow at a lower pressure, that is, the returning oil, in the return channel is conducted from the pistons into channel $B_1$ and into a space D in between the broadened parts $G_1$ and $G_2$ of the spindle in a spindle cavity 52, such as a bore, from which oil is moved into channel F and further into the channel system of distributing valve 16 and further to certain pistons V, which are under working pressure, and to the cylinders $Va_2$ under a lower pressure, that is, under non-working pressure. This is a so-called partial volume mode, for example, a ½ volume mode, whereby the motor has a higher speed of rotation and a lower moment than in the so-called full volume mode. The operation of the bank of cylinders/pistons $Va_2$ is hereby turned off, so to speak, and it circulates oil under idle pressure in a closed loop formed by the circuit $B_1$, F.

FIG. 2 shows the control spindle moved to a position, where the piston $G_2$, that is, the so-called neck, enters between the channels F and $B_1$ and closes the connection from channel $B_1$ to channel F, to which a connection is opened for the pressurized oil flow in channel $A_2$. In the position of the control spindle shown in the figure, pressurized oil is conducted from channel $A_2$ to the left side of piston $G_2$, that is, the neck, in the figure and further into channel F and further to the distributing valve and through this under full pressure to certain pistons $Va_2$, which are in the working phase. The banks of piston-type cylinders $Va_1$+$Va_2$ are hereby in operation for the oil supplied under full pressure from pump $P_1$. The bank of piston-type cylinders $Va_1$ for the pressurized oil supplied through channel $A_1$ is always in operation.

The control spindle 51 of the actuator, that is, control valve 50, is controlled according to the pressure existing in channel $A_1$. If the pressure in channel $A_1$ falls under a certain critical value, the control spindle will move under the effect of a spring J to the position shown in FIG. 1 and the mode 1 according to FIG. 1 is achieved, whereby only a part, for example, a half of the pistons in bank $Va_1$ will receive working pressure, whereas the rest, group $Va_2$, will have the pressure of the feedback of returning circulation, a so-called idle pressure, whereby the bank $Va_2$ is not actually in operation.

If the pressure in channel A, rises, control spindle 51 is moved to the position shown in FIG. 2 by a pressure produced at the left end of spindle 51. The function of the spring J located in between the right-hand end of the spindle cavity 52 of control spindle 51 and the spindle neck $G_1$ is to act as a counterforce to the force brought about by the control pressure. When choosing an operating mode for the multi capacity motor 10, spindle 51 is thus moved with the aid of a control pressure brought to the left-hand end (in the figure) of the spindle cavity 52, as shown by arrows $L_1$, against the spring force of spring J.

In all modes of operation, both at the full rotational volume and at the partial rotational volume, the bank of cylinders/pistons $Va_1$ in connection with the working pressure channel $A_1$ is always in operation.

Figure 3:
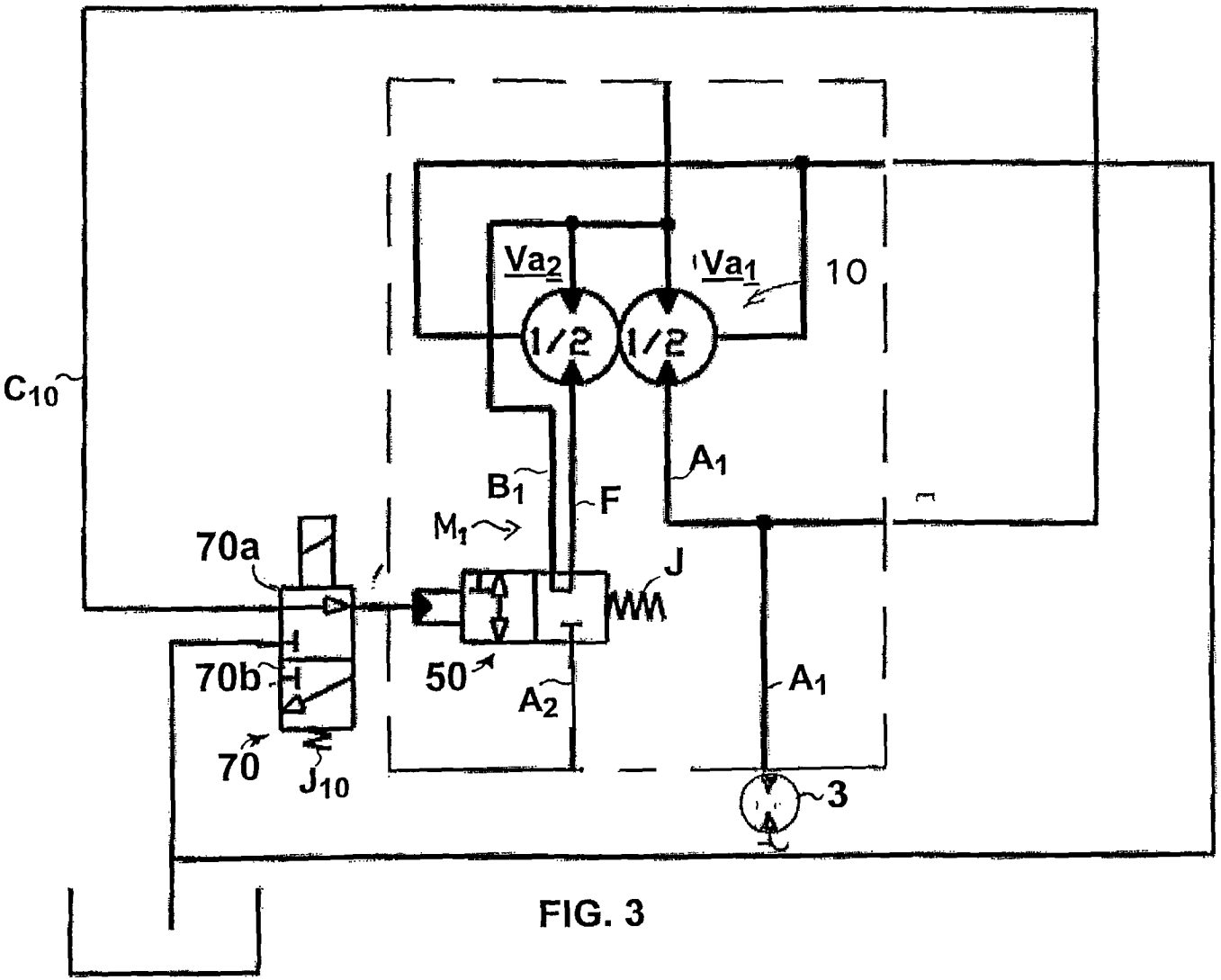
FIG. 3 is a schematic view of the hydraulic system of the motor shown in FIGS. 1 and 2.

FIG. 3 is a schematic view of the hydraulic system of the motor 10 according to FIGS. 1 and 2. Hydraulic oil is brought under pressure along two channels $A_1$ and $A_2$ to a multi capacity motor 10. From the multi capacity motor 10 there is a loop, that is, a system of channels $M_1$, which is used to circulate oil by way of the pistons under non-working pressure inside the motor. As is shown in the figure, the system further comprises a pipe fitting $C_{10}$ or channel or other such to conduct control pressure to the valve 50 from channel $A_1$, which can be used to control such a mode for the multi capacity motor 10, which implements a partial rotational volume and a pure connection in series of successive hydraulic motors as the concerned multi capacity motor tends to slip.

FIG. 3 also shows a directional control valve 70 with solenoid control against the spring force of spring $J_{10}$. When the directional control valve section 70*a* is turned on as shown in the figure, the pressure existing in line $C_{10}$ is detected and it is moved to the end of the spindle 51 of actuator 50, preferably a valve set-up, to affect the valve spindle against the spring force of spring J. When section 70*b* of the directional control valve 70 is turned on, when no control voltage is supplied to the solenoid, the connection of pressure line $C_{10}$ with spindle 51 is closed, whereby the spring J of actuator 50 will move the spindle to a position, where section $Va_2$ is closed and the motor is operated at a higher speed.

FIG. 4 is a schematic view of another type of hydraulic motor 30, which operates in a corresponding manner as the shown multi capacity motor 10 and which in this embodiment comprises corresponding structural components as in the earlier figures. The essential difference in this embodiment is that the shaft 32 with its piston body 33 is rotating. The actual casing 31 of motor 30 and the connected distributor 36, that is, the distributing valve and the cam ring 35 are non-rotating. In the full volume solution $Va_1$+$Va_2$ oil under working pressure is conducted to all pistons/cylinders $Va_1$, $Va_2$ of the piston body through channels $A_1$ and $A_2$, through the distributor 36 and the non-rotating casing 31 of motor 30. The device arrangement and the operation are the same as in the embodiment in FIGS. 1, 2 and 3 presented above, where the casing 11 of the radial piston hydraulic motor 10 and the distributor 16 are rotated and in which embodiment the shaft 12 and the piston body 13 are in a fixed position. In the embodiment of FIG. 4, the casing 31 of the hydraulic motor 30 and the connected distributing valve 36 are non-rotating. The shaft 32 of motor 30 and the connected piston body 33 are rotating. The operation of the embodiment is the same as the operation of the embodiment of the hydraulic motor shown in the earlier FIGS. 1, 2 and 3.

Figure 5:
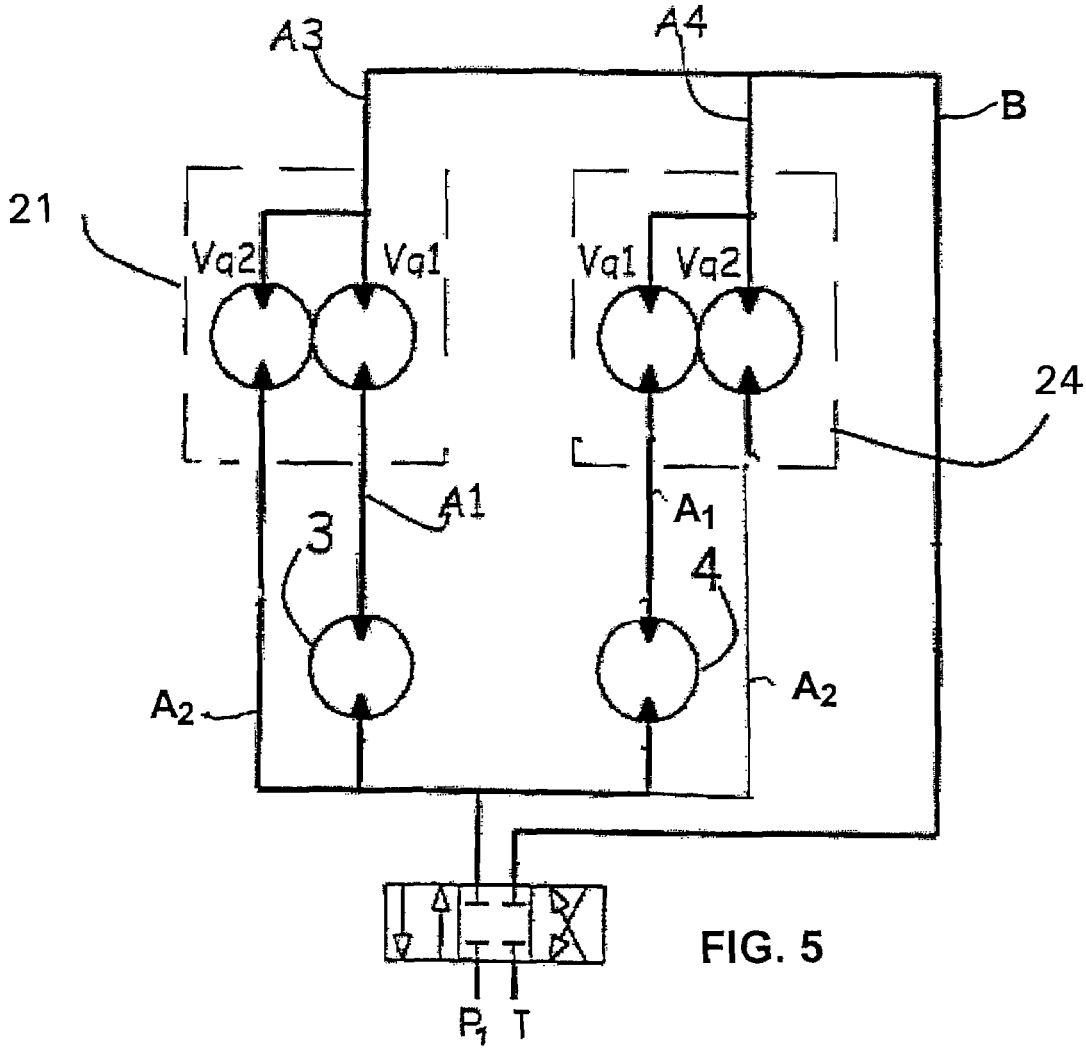
FIG. 5 shows a piston hydraulic motor in the anti-slip regulation of a harvester.

FIG. 5 shows a multi capacity motor 21 adapted for an anti-slip regulation for a timber supply. The multi capacity motor 21 is located to supply timber together with another multi capacity motor structure 24, which is placed in parallel with said first motor 21. A bank of cylinders/pistons $Va_1$ of motor 21 is connected in series with a conventional hydraulic motor 3 and another bank of cylinders/pistons $Va_1$ of multi capacity motor 24 is in series with another conventional hydraulic motor 4. The bank of cylinders/pistons $Va_2$ of the multi capacity motors are connected in both motors directly to the pump channel $A_2$ and to pump $P_1$, whereby this is a connection in parallel with the motors as regards banks $Va_2$. When the motor tends to slip when supplying timber at full rotational volume $Va_1+Va_2$, the operation of bank $Va_2$ is turned off with the aid of the arrangement shown in FIG. 3.

Figure 6:
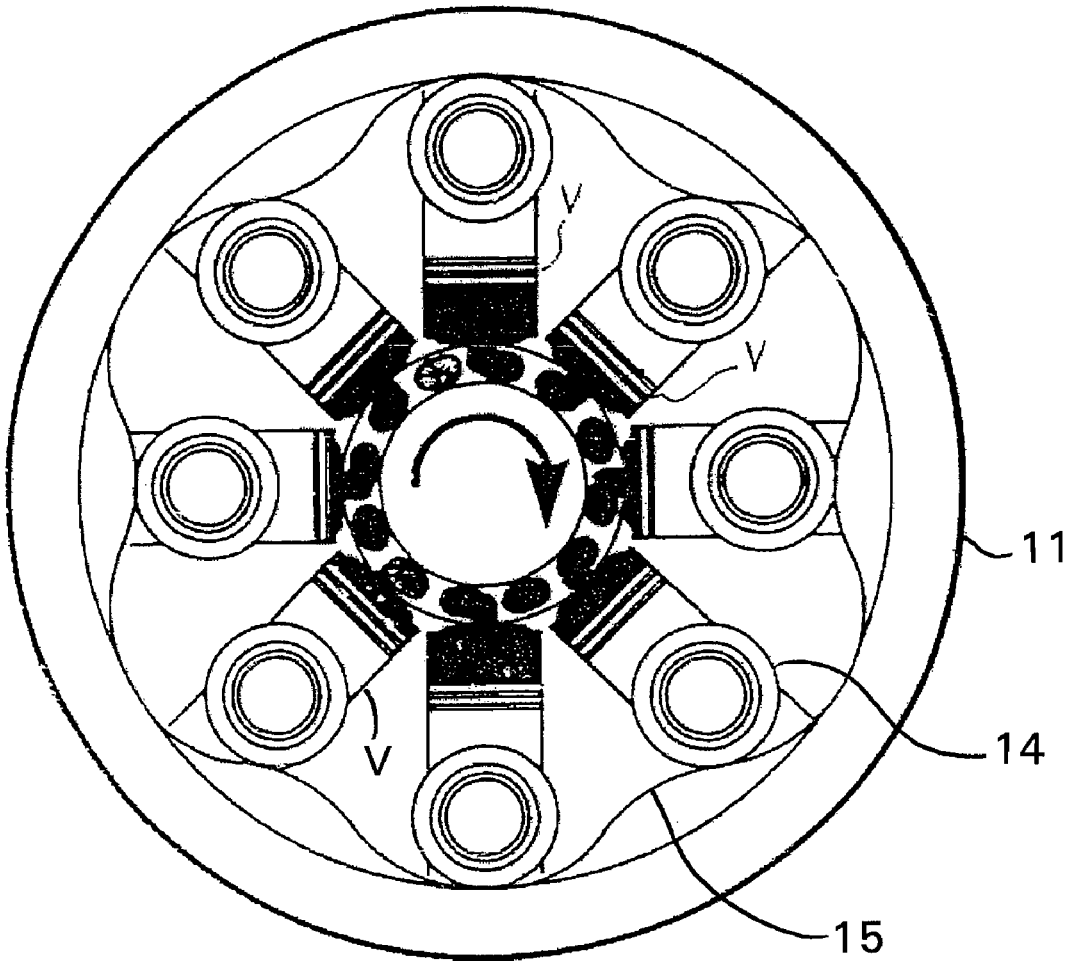
FIG. 6 is a cross-sectional view of a radial piston hydraulic motor.

FIG. 6 is an illustrating presentation in connection with the state of the art of radial cylinders and pistons. The embodiment in the figure has eight pistons and thus eight cylinders, and thus the bank of pistons/cylinders $Va_1$ may comprise, for example, four pistons and cylinders connected with these and, correspondingly, the bank $Va_2$ may comprise correspondingly, four pistons and cylinders.

FIG. 6 shows a cross-section of a radial piston hydraulic motor, which comprises eight hydraulic cylinders and pistons connected with these.

In the $Va_1+Va_2$ mode, hydraulic oil under working pressure is conducted to all pistons, which are in the working phase. In the $Va_1$ mode, hydraulic oil under working pressure is only conducted to the bank $Va_1$, whereas in said mode only hydraulic oil under a low pressure, not oil under working pressure, is conducted to the bank $Va_2$ even to its pistons, which are in the working phase. However, the pistons, which are in the working phase at each time under the working pressure of pump $P_1$, may vary in one and the same hydraulic motor.

In this application, a channel means pipes, hoses, bores and other corresponding fittings. In this application, the name mode or operating mode or partial or full rotational volume is used for certain banks of cylinders and their connected pistons of the multi capacity motor. The rotational volume may be a full rotational volume $Va_1+Va_2$ or a partial rotational volume $Va_1$.

I claim:

1. A radial-piston hydraulic motor comprising:

a fixed central shaft with a plurality of piston bodies with a plurality of pistons, one of said plurality of pistons mounted in each piston body for radial motion;

a plurality of presser wheels, one of said plurality of presser wheels mounted on each piston;

a casing surrounding the central shaft, and the casing mounted for rotation on the central shaft;

a cam ring having a wave-shaped surface mounted to the casing so that the presser wheels mounted to the pistons bear on the cam ring wave-shaped surface;

wherein the plurality of piston bodies are divided into a first group of piston bodies and a second group of piston bodies;

first portions of the central shaft forming a first supply channel which is connected to the first group of piston bodies by a distributor mounted to rotate with the casing;

second portions of the central shaft forming a second supply channel which is connected to the second group of piston bodies by the distributor;

an actuator which is actuated by a pressure in the first supply channel to open and close the second supply channel with respect to the second group of piston bodies, the actuator connected to the first supply channel by a structure arranged to transmit a pressure medium from the first supply channel such that when pressure in the pressure medium in the first supply channel falls below a selected value the actuator closes the second supply channel with respect to the second group of piston bodies, so that only the first supply channel conducts the pressure medium at a working pressure to the first group of piston bodies and the second group of piston bodies are turned off and thus not operating at the working pressure.

2. The motor of claim 1 wherein the actuator is mounted in the central shaft, with third portions of the central shaft forming a bore having a first end at which is mounted a spring and a second end in actuation pressure receiving relation to the first supply channel and further comprising a spindle mounted for movement in the bore.

3. The motor of claim 1 wherein the actuator is located outside the hydraulic motor.

4. A radial-piston hydraulic motor comprising:

a fixed central shaft with a plurality of piston bodies with a plurality of pistons, one of said plurality of pistons mounted in each piston body for radial motion;

a plurality of presser wheels, one of said plurality of presser wheels mounted on each piston;

a casing surrounding the central shaft, and the casing mounted for rotation on the central shaft;

a cam ring having a wave-shaped surface mounted to the casing so that the presser wheels mounted to the pistons bear on the cam ring wave-shaped surface;

wherein the plurality of piston bodies are divided into a first group of piston bodies and a second group of piston bodies;

first portions of the central shaft forming a first supply channel which is connected to the first group of piston bodies by a distributor mounted to rotate with the casing;

second portions of the central shaft forming a second supply channel which is connected to the second group of piston bodies by the distributor;

an actuator arranged to open and close the second supply channel with respect to the second group of piston bodies, the actuator in actuation pressure receiving relation to the first supply channel such that when pressure in a pressure medium in the first supply channel falls below a selected value the actuator closes the second supply channel with respect to the second group of piston bodies, so that only the first supply channel conducts the pressure medium at a working pressure to the first group of piston bodies and the second group of piston bodies are turned off and thus not operating at the working pressure;

further comprising:

a second hydraulic motor having an inlet connected to a source of the pressure medium at a working pressure and an outlet for hydraulic fluid that passes through the radial piston hydraulic motor;

wherein the first supply channel and the first group of piston bodies is arranged in series with the second hydraulic motor so that the first supply channel is connected to receive hydraulic fluid from the outlet for hydraulic fluid of the second hydraulic motor, and the second supply channel which is connected to the second group of piston bodies is connected directly to the source of pressure medium at a working pressure;

wherein when the radial-piston hydraulic motor slips, pressure in the first supply channel falls below the selected pressure, and the actuator is arranged to close the second supply channel with respect to the second group of piston bodies.

5. A radial-piston hydraulic motor comprising:

a fixed casing;

a central shaft mounted within the casing for rotation, the shaft having a plurality of piston bodies with a plurality of pistons, one of said plurality of pistons mounted in each piston body for radial motion;

a plurality of presser wheels, one of said plurality of presser wheels mounted on each piston;

a cam ring having a wave-shaped surface mounted to the casing so that the presser wheels mounted to the pistons bear on the cam ring wave-shaped surface;

wherein the plurality of piston bodies are divided into a first group of piston bodies and a second group of piston bodies;

first portions of the casing forming a first pressure medium supply channel which is connected to the first group of piston bodies by a distributor mounted to the fixed casing;

second portions of the casing forming a second supply channel which is connected to the second group of piston bodies by the distributor;

an actuator which is actuated by a pressure in the first supply channel to open and close the second supply channel with respect to the second group of piston bodies, the actuator connected to the first pressure medium supply channel by a structure arranged to transmit a pressure medium from the first pressure medium supply channel such that when pressure in the pressure medium in the first supply channel falls below a selected value, the actuator closes the second supply channel with respect to the second group of piston bodies, so that only the first supply channel conducts the pressure medium at a working pressure to the first group of piston bodies and the second group of piston bodies are turned off and thus not operating at the working pressure.

6. A radial-piston hydraulic motor comprising:

a central shaft with a plurality of piston bodies with a plurality of pistons, one of said plurality of pistons mounted in each piston body for radial motion;

a plurality of presser wheels, one of said plurality of presser wheels mounted on each piston;

a casing surrounding the central shaft, and the casing and the central shaft mounted for rotation with respect to each other, so that one of the central shaft or the casing comprises a rotating member, and the other a fixed member;

a cam ring having a wave-shaped surface mounted to the casing so that the presser wheels mounted to the pistons bear on the cam ring wave-shaped surface;

wherein the plurality of piston bodies are divided into a first group of piston bodies and a second group of piston bodies;

first portions of the fixed member forming a first supply channel which is connected to the first group of piston bodies by a distributor;

second portions of the fixed member forming a second supply channel which is connected to the second group of piston bodies by the distributor;

an actuator which is actuated by a pressure in the first supply channel to open and close the second supply channel with respect to the second group of piston bodies, the actuator being connected to the first supply channel by a structure arranged to transmit a pressure medium from the first supply channel such that when pressure in the pressure medium in the first supply channel falls below a selected value the actuator closes the second supply channel with respect to the second group of piston bodies, so that only the first supply channel conducts the pressure medium at a working pressure to the first group of piston bodies and the second group of piston bodies are turned off and thus not operating at the working pressure.

* * * * *